US010029815B2

(12) United States Patent
Robinson et al.

(10) Patent No.: US 10,029,815 B2
(45) Date of Patent: Jul. 24, 2018

(54) BAGGING STATION FOR FILLING PAPER-TYPE BAGS

(71) Applicant: Wal-Mart Stores, Inc., Bentonville, AR (US)

(72) Inventors: Levi Robinson, Centerton, AR (US); Yurgis Mauro Bacallao, Centerton, AR (US); John Levy, Fayetteville, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/415,026

(22) Filed: Jan. 25, 2017

(65) Prior Publication Data

US 2017/0217621 A1 Aug. 3, 2017

Related U.S. Application Data

(60) Provisional application No. 62/288,580, filed on Jan. 29, 2016.

(51) Int. Cl.
*B65B 67/12* (2006.01)
*A47F 9/04* (2006.01)

(52) U.S. Cl.
CPC ..... *B65B 67/1233* (2013.01); *A47F 9/043* (2013.01); *B65B 67/1211* (2013.01); (Continued)

(58) Field of Classification Search
CPC ..... B65B 67/1233; B65B 67/1211; B65B 67/1227; B65B 67/1266; B65B 67/1238; (Continued)

(56) References Cited

U.S. PATENT DOCUMENTS 473,099 A 4/1892 Vincentz
721,996 A 12/1902 Bunnell
(Continued)

FOREIGN PATENT DOCUMENTS

JP 6096712 B2 3/2017
WO 2006130911 A1 12/2006

OTHER PUBLICATIONS

Weimaamerica, "Carousel Bagging System for WEIMA Briquette Press," YouTube.com, Apr. 15, 2009.
(Continued)

*Primary Examiner* — Patrick D Hawn
(74) *Attorney, Agent, or Firm* — Schmeiser, Olsen & Watts LLP

(57) ABSTRACT

A bagging station for filling paper-type bags is disclosed. Described is a bagging station that includes a base and a center piece. The center piece has a cavity for storing a stack of paper or paper-type bags. The center piece rests on top of the base. The base is used to support one or more open paper bags while the paper bags are being filled. The base can include a carousel that rotates, where the center piece sets on the carousel. The center piece has a bag storage cavity for storing a stack of paper bags. The center piece also includes one or more paper bag upper edge holders, where each paper bag upper edge holder grasps the upper edge of an open paper bag in order to hold the bag open and in place while items are placed in the paper bag.

13 Claims, 6 Drawing Sheets

(52) U.S. Cl.
CPC ..... *B65B 67/1227* (2013.01); *B65B 67/1266* (2013.01); *B65B 2067/1261* (2013.01); *B65B 2067/1294* (2013.01)

(58) Field of Classification Search
CPC ..... B65B 67/12; B65B 2067/1294; B65B 2067/1261; A47F 9/043; A47F 9/042; A47F 9/045; A47F 13/085
USPC ..... 186/66
See application file for complete search history.

(56) References Cited

U.S. PATENT DOCUMENTS 743,547 A 7/1903 Nix
1,754,327 A 4/1930 Leonard
2,324,596 A * 7/1943 Quain ..... D06F 93/00 108/139
3,055,508 A 9/1962 Reeser
3,175,793 A 3/1965 Kennedy
3,628,632 A * 12/1971 Lambert ..... A47F 9/043 186/66
3,838,839 A 10/1974 Spencer
3,847,332 A 11/1974 Murai
4,106,733 A 8/1978 Walitalo
4,106,734 A 8/1978 Walitalo
4,398,689 A * 8/1983 Prader ..... B65B 67/1227 248/99
4,498,652 A 2/1985 Malik
RE33,122 E 12/1989 Orem
5,012,994 A 5/1991 Keefe
5,054,728 A 10/1991 Nigro, Jr.
5,131,499 A * 7/1992 Hoar ..... B65B 67/04 186/66
5,462,178 A * 10/1995 Wallach ..... A47F 5/02 211/163
5,467,572 A * 11/1995 Wile ..... B65B 43/14 206/554
5,885,002 A * 3/1999 Reiss ..... B65F 1/1415 220/495.09
6,474,478 B1 11/2002 Huehner et al.
6,491,218 B2 12/2002 Nguyen
6,550,583 B1 4/2003 Brenhouse
7,106,733 B2 9/2006 Fleming
7,516,820 B1 4/2009 Cox
7,753,588 B2 7/2010 Bazbaz
7,866,546 B1 * 1/2011 Vance ..... G07G 1/14 235/379
8,400,324 B1 * 3/2013 Jaeger ..... G08B 21/24 232/62
8,678,281 B2 3/2014 Kangas et al.
9,101,232 B1 8/2015 Newman
9,622,598 B1 * 4/2017 Davis, Jr. ..... A47F 9/042
9,622,599 B2 * 4/2017 Davis, Jr. ..... A47F 13/085
9,750,356 B2 9/2017 Tan
2004/0112850 A1 6/2004 Jordan
2005/0114216 A1 5/2005 Lantz et al.
2005/0258177 A1 11/2005 Woodson
2007/0181753 A1 8/2007 Herlands
2009/0289019 A1 * 11/2009 Alvarado ..... A47F 13/085 211/85.15
2010/0021088 A1 * 1/2010 Wilfong, Jr. ..... B65D 33/02 383/23
2010/0096514 A1 * 4/2010 Adair ..... B65B 67/1227 248/100
2010/0148019 A1 * 6/2010 Simhaee ..... B65B 67/1227 248/97
2010/0314507 A1 * 12/2010 Laitila ..... B65B 67/1227 248/97
2011/0266092 A1 11/2011 Marquis et al.
2013/0223766 A1 * 8/2013 Gebhardt ..... A47F 13/085 383/6
2013/0259405 A1 * 10/2013 Jack ..... B65B 67/04 383/33
2014/0138499 A1 5/2014 Laitila et al.
2015/0048039 A1 * 2/2015 Laitila ..... A47F 13/085 211/85.15
2017/0020307 A1 * 1/2017 Davis, Jr. ..... B65B 67/1266
2017/0217621 A1 * 8/2017 Robinson ..... B65B 67/1233
2017/0280900 A1 * 10/2017 Bacallao ..... A47F 9/042

OTHER PUBLICATIONS

Web page image 1, accessed Dec. 29, 2015, https://www.google.co.in/imgres?imgurl=https://c1.staticflickr.com/3/2932/14248018844_89e3d89fa4_b.jpg&imgrefurl=https://www.flickr.com/photos/ieepersmedia/14248018844&h=950&w=1024&tbnid=MyLI_TOn6HIMCM:&docid=9feoV3Exk3O-4M&ei=jfyAVsbyJMPluASeoa6QBw&tbm=isch&ved=0ahUKEwiG7Z7tmv7JAhVDJI4KHZ6QC3IQMwgkKAkwCQ.
Web page image 2, accessed Dec. 29, 2015, https://www.flickr.com/photos/fourstarcashiernathan/6979145827.
"Over Door Bag Holder Waste Bin, Hang Over Kitchen Door, Reuses Shopping Bags," Klife, Ebay.com, accessed on May 23, 2016; 4 pages.
"100mm metal wire clip/clipboard clip," Dongguan Taoyuan Stationary Co., Ltd., Sell.Lulusoso.com, accessed May 20, 2016; 4 pages.
Non-Final Office Action in U.S. Appl. No. 15/695,401 dated Feb. 2, 2018; 7 pages.
Non-Final Office Action for U.S. Appl. No. 15/695,306, dated Apr. 18, 2018.
Notice of Allowance for U.S. Appl. No. 15/695,401, dated May 4, 2018.

* cited by examiner

BAGGING STATION FOR FILLING PAPER-TYPE BAGS

CROSS REFERENCE TO RELATED APPLICATION

This invention claims priority to U.S. provisional patent application Ser. No. 62/288,580, filed Jan. 29, 2016 to Applicant Wal-Mart Stores Inc., and entitled "Bagging Station for Filling Paper Bags", which is included entirely herein by reference.

BACKGROUND OF THE INVENTION

Technical Field

This invention relates to bagging stations used in retail stores for loading purchased items into bags and, more specifically, to a bagging station for loading paper-type bags.

State of the Art

A bagging station is a fixture in a retail store where purchases are placed into bags so that the bags, with the purchases, may be carried out of the store by the customer. Bagging stations are often designed to hold a plurality of bags, and have a ledge or shelf on which a customer or bagger can set the bag while it is being filled. Because plastic bags are so popular these days, most bagging stations are designed to hold plastic shopping bags. In areas where paper bags are desired or required, bagging stations are often modified to use paper bags, but the modified plastic bag bagging stations do not do a very good job of storing or holding paper bags for filling.

Accordingly, what is needed is a bagging station for filling paper bags that stores a plurality of paper bags and conveniently holds one or more paper bags open for filling with purchased products.

DETAILED DESCRIPTION OF EMBODIMENTS OF THE INVENTION

As discussed above, embodiments of the present invention relate to bagging stations in retail stores for loading purchased items into bags, and, more specifically, to a bagging station for filling paper-type bags.

Bagging stations are fixtures in retail stores where bags are available to be filled with purchased products, as well as a surface for placing bags as they are filled. With the popularity of plastic shopping bags, most bagging stations are designed to hold and dispense plastic shopping bags. There is a need, however, for bagging stations that hold and dispense paper-type bags, for use in locations where paper bags are desired by the customers or required by regulation. Described herein is a bagging station that is used to hold and dispense paper and paper-type bags. Paper-type bags includes paper bags, as well as composite bags that are formed of paper-like materials and that are allowed for use in areas that ban or discourage the use of plastic bags. In some embodiments, paper-type bags are formed of semi-rigid material so that the paper-type bag opens and sits on a surface in an open state, without having to be held up or open like a plastic bag. The description herein describes the use of paper bags with the bagging station, but it is to be understood that paper-type bags can be used instead of, or in addition to, the paper bags shown in the figures and discussed in the specification. The bagging station includes a base and a center piece. The center piece has a cavity for storing a stack of paper or paper-type bags. The center piece rests on top of the base. The base is used to set one or more open paper bags on top of, while the paper bags are being filled. In some embodiments, the base includes a carousel that rotates, and the center piece sets on the carousel. The center piece has a bag storage cavity for storing a stack of paper bags. The center piece also includes one or more paper bag upper edge holders, where each paper bag upper edge holder grasps the upper edge of an open paper bag in order to hold the bag open and in place while items are placed in the paper bag. The disclosed bagging station can be used in stores or locations where it is desirable to use paper shopping bags instead of plastic shopping bags.

The disclosed bagging station includes a means to store a stack of paper bags, and a means to secure an upper edge of a paper bag so that the paper bag can be filled. In some embodiments, the bagging station includes a means to support the paper bag while the paper bag is being filled. In some embodiments, the means to store the stack of paper bags is in a center piece. In some embodiments, the means to secure the upper edge of a paper bag is a means to secure the upper edge of a paper bag to the center piece.

Figure 1:
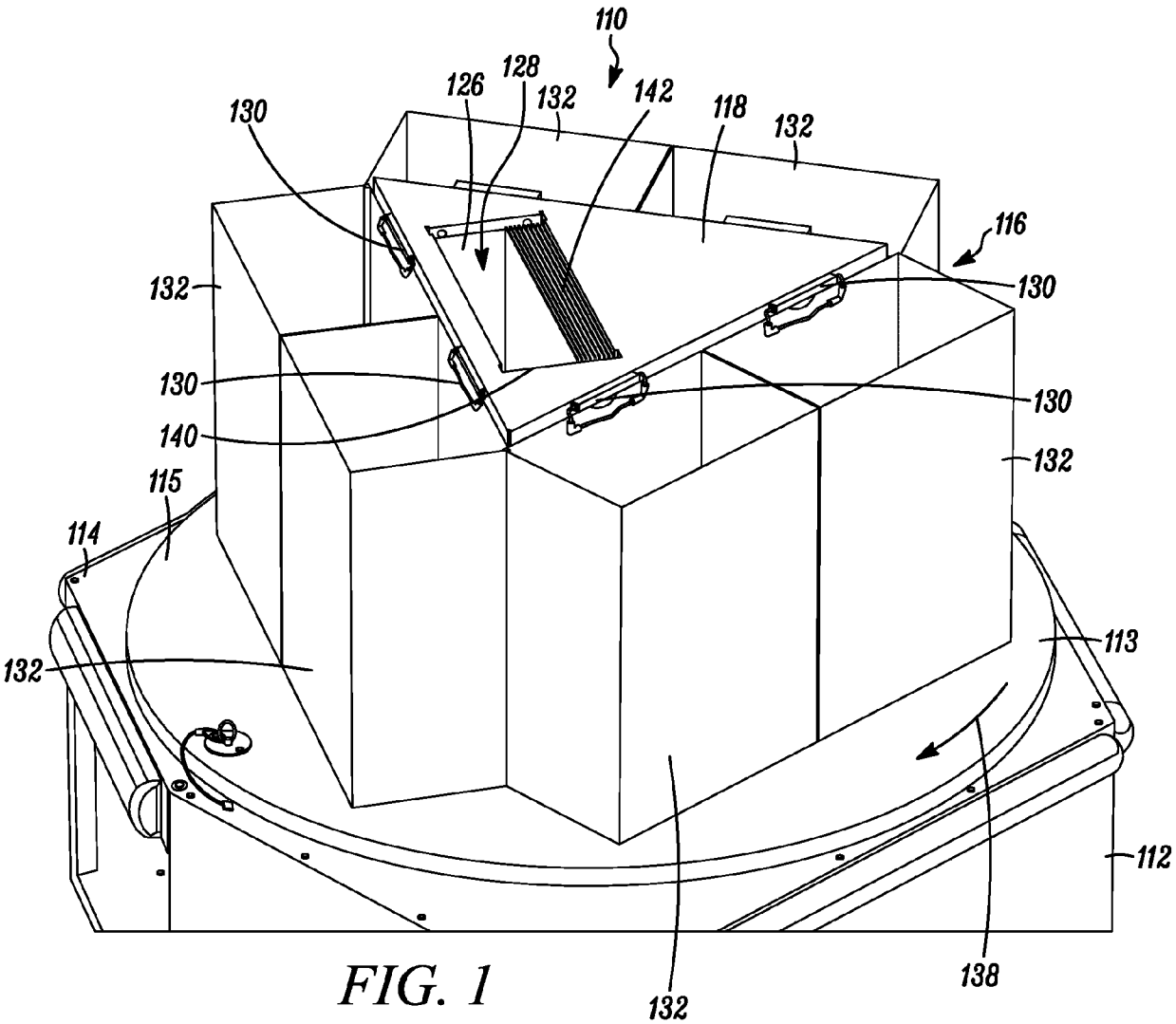
FIG. 1 shows a top perspective view of a bagging station for filling paper-type bags.
Figure 2:
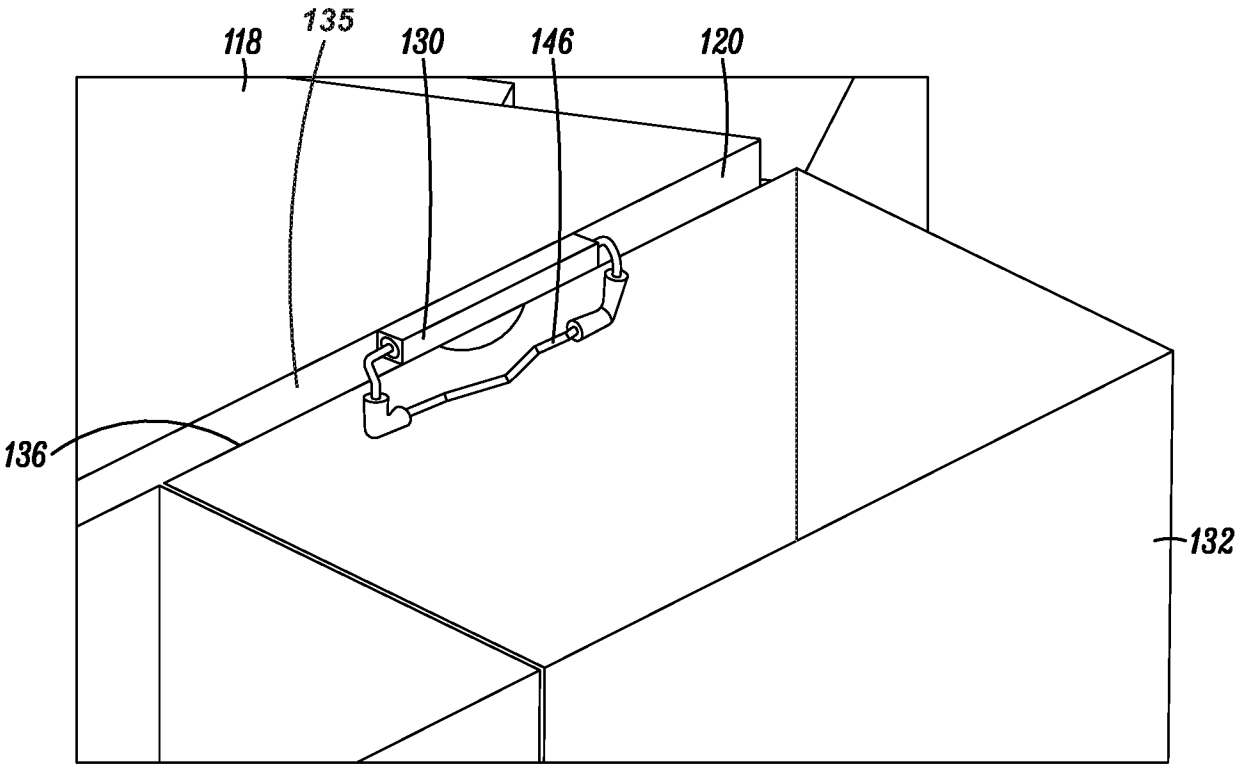
FIG. 2 shows a close up view of a paper bag upper edge holder of the bagging station of FIG. 1, where the paper bag upper edge holder is holding the upper edge of a paper bag.
Figure 3:
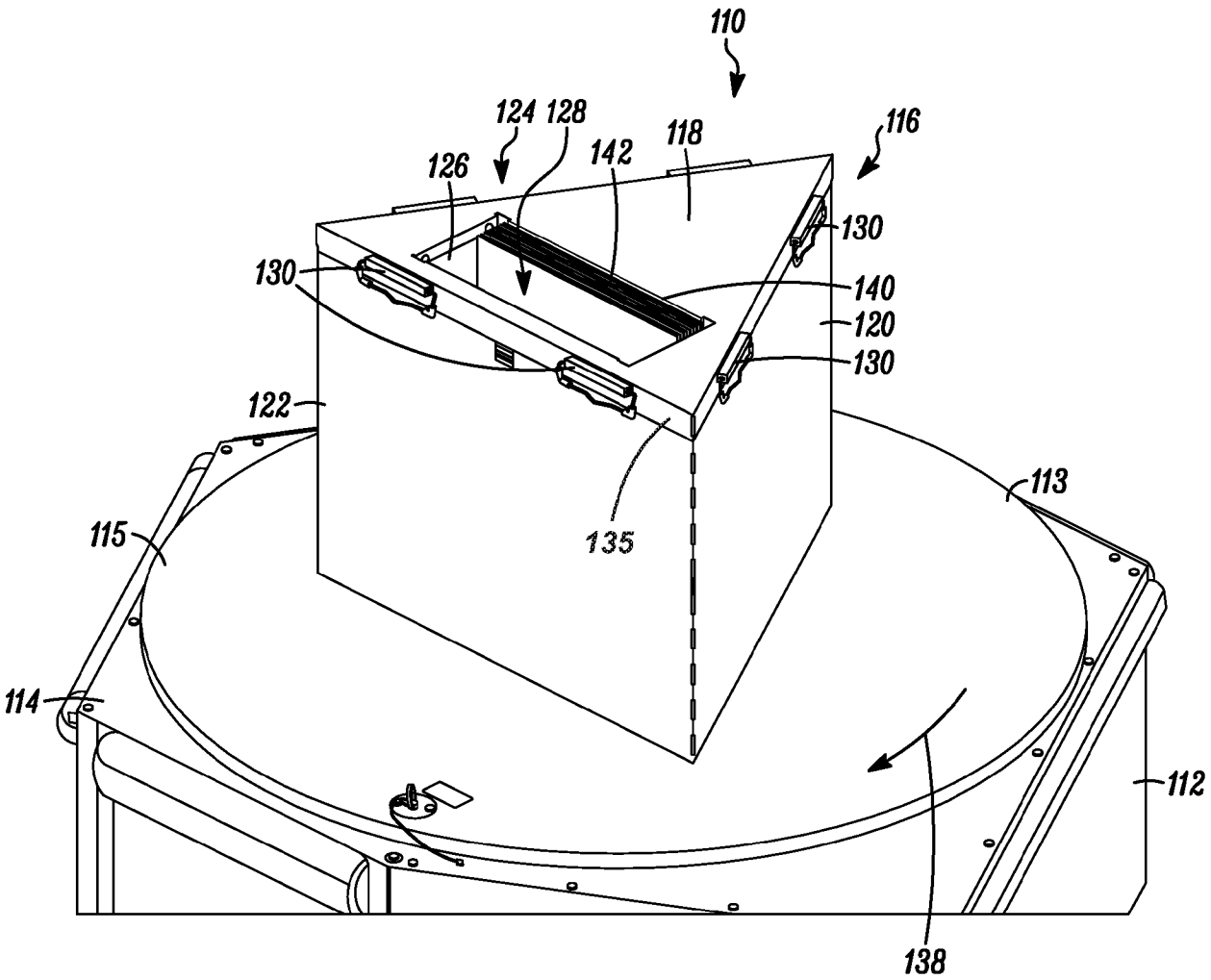
FIG. 3 shows a top perspective view of the bagging station for filling paper-type bags of FIG. 1 with no open paper bags.
Figure 4:
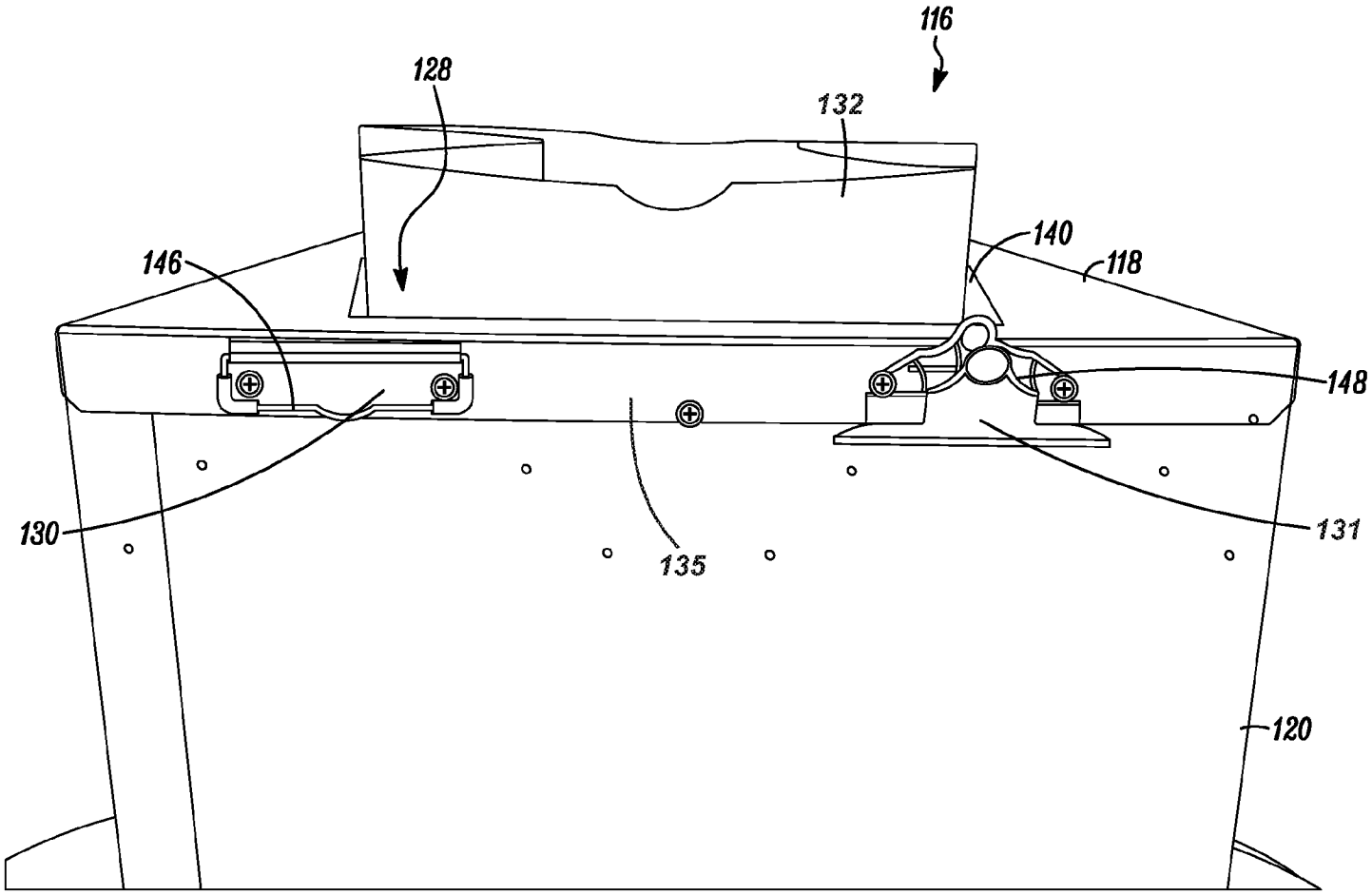
FIG. 4 shows a close up view of a lid of a bagging station center piece, and two paper bag edge holders of a bagging station.
Figure 5:
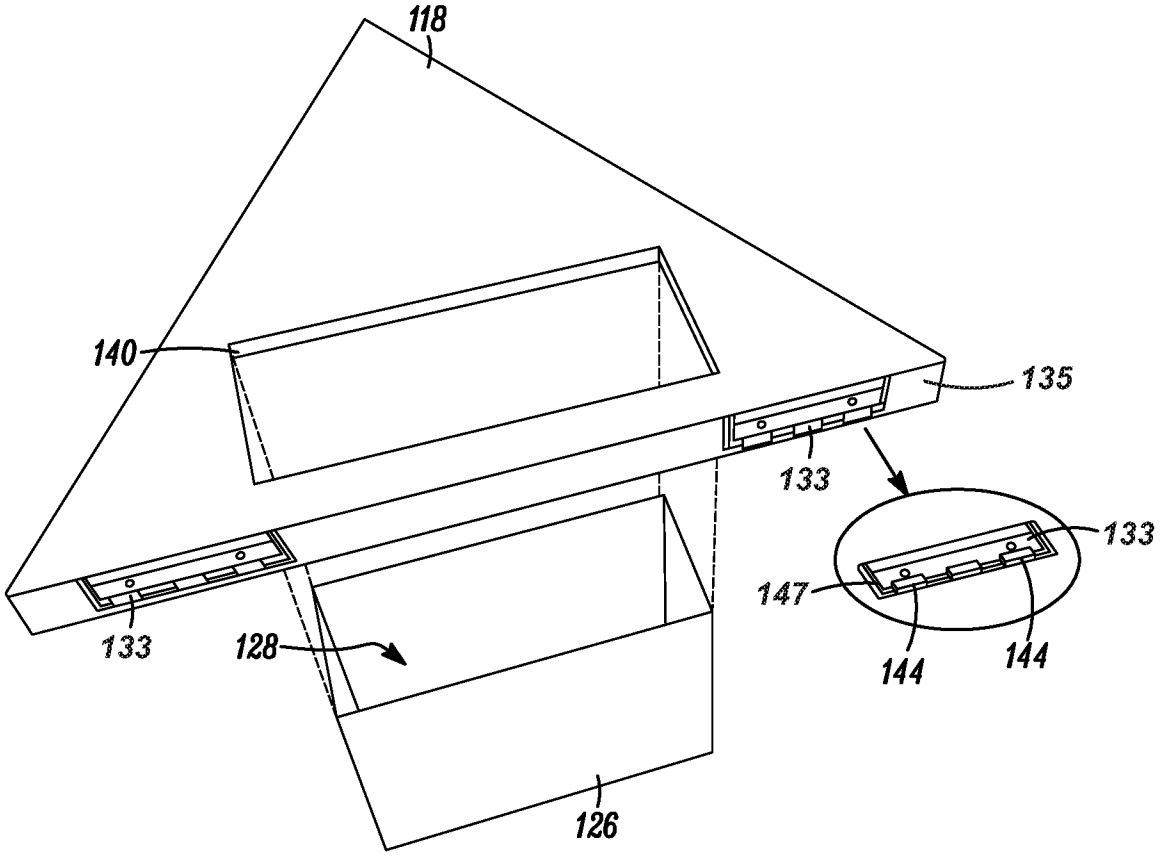
FIG. 5 shows an exploded view of a lid of a center piece of a bagging station and a paper bag storage basket.

FIG. 1 through FIG. 5 shows embodiments of a paper-type bag bagging station 110 and its elements. FIG. 1 shows a top perspective view of paper-type bag bagging station 110, with six paper bags 132 held open and ready to receive items. FIG. 2 shows a close up of a paper bag edge holder 130 of bagging station 110 holding an upper edge 136 of a paper bag 132. FIG. 3 shows a top perspective view of bagging station 110 without paper bags 132. FIG. 4 shows a close-up view of a lid 118 of a center piece 116 of bagging station 110, showing how a stack of paper bags 142 is stored in cavity 128 in center piece 116. FIG. 5 shows an exploded view of lid 118 and a paper bag storage basket 126, showing how paper bag storage basket 126 is mounted beneath an opening 140 in lid 118.

Bagging station 110 is used to store and dispense a stack of paper bags 142, as shown in FIG. 1 and FIG. 3. Bagging station 110 is also used to hold one or more paper bags 132 open, so that paper bags 132 may be filled with purchased items, as shown in FIG. 1. In some embodiments, bagging station 110 is used to store and dispense a stack of paper-type bags.

Bagging station 110 includes base 112 and center piece 116 (best seen in FIG. 3). Base 112 acts as a table to hold center piece 116, and is a means to support one or more paper bags 132 while paper bag 132 is filled (see FIG. 1). In this embodiment, base 112 includes a carousel 113, which rotates in a direction 138 for ease of access to multiple paper bags 132. Carousel 113 is coupled to a top 114 of base 112.

Center piece 116 in this embodiment rests on, and is coupled to, a top surface 115 of carousel 113, see FIG. 1 and FIG. 3. Center piece 116 in this embodiment includes lid 118 and paper bag storage basket 126, as shown in FIG. 3 and FIG. 5. Center piece 116 has three sides 120, 122, and 124, as can best be seen in FIG. 3. Lid 118 is triangular in shape in this embodiment with at least one side 135 (FIG. 2 through FIG. 5). Center piece 116 has a bag storage cavity 128 for storing a stack of paper bags 142 or other paper-type bags. In this embodiment, center piece 116 is the means to store stack of paper bags 142. In some embodiments, center piece 116 has more than three sides, and lid 118 is a shape other than triangular, such as rectangular, round, oval, or other shape.

Bag storage cavity 128 in this embodiment is inside of paper bag storage basket 126 (see FIG. 1, FIG. 3, and FIG. 5). Bag storage cavity 126 includes an opening 140 in lid 118. Bag storage cavity 128 extends into center piece 116 from lid 118 to hold stack of paper bags 142. Paper bag storage basket 126 is mounted below opening 140 in lid 118 (best seen in FIG. 5). Paper bag storage basket 126, and bag storage cavity 128 within paper bag storage basket 126, are sized and shaped to hold stack of paper bags 142. In this embodiment, paper bag storage basket 126, opening 140, and cavity 128 are rectangular shaped, but that is not meant to be limiting. In some embodiments, paper bag storage basket 126, opening 140, or cavity 128 have other shapes.

Bag storage cavity 128 in paper bag storage basket 126 holds stack of paper bags 142. When a customer or bagger wishes to place their items in a paper bag 132, they retrieve a paper bag 132 from stack of paper bags 142, and fill it with purchased items. Paper bag 132 can be placed on top surface 115 of carousel 113 for filling.

Bagging station 110 in this embodiment includes one or more paper bag edge holders 130, 131, or 133, as shown in the figures. Paper bag edge holders 130, 131, and 133 are each means to secure an upper edge of paper bag 132 so that paper bag 132 can be filled. In some embodiments, bagging station 110 does not include paper bag edge holders 130, 131, or 133. In some embodiments, bagging station 110 includes at least one paper bag edge holder 130, 131, or 133 mounted to at least one of sides 120, 122, or 124. In some embodiments, bagging station 110 includes at least one paper bag edge holder 130, 131, or 133 mounted to at least one side 135 of lid 118. In the embodiment shown in FIG. 1, FIG. 2, and FIG. 3, bagging station 110 includes six paper bag edge holders 130, with two paper bag edge holders 130 attached to side 135 on each of sides 120, 122, and 124 of center piece 116, see FIG. 1, FIG. 3, and FIG. 4.

Each paper bag edge holder 130 is coupled to one of sides 120, 122, or 124 and/or side 135 of lid 118, as shown in FIG. 2 and FIG. 3. Each paper bag edge holder 130 is configured to hold an upper edge 136 of a paper bag 132 as shown in close-up view in FIG. 2. FIG. 2 shows paper bag edge holder 130, which in this embodiment is a clip including a spring clip 146, holding upper edge 136 of paper bag 132. Paper bag 132 sits on carousel 113 as shown in FIG. 1, so that carousel 113 supports paper bag 132 and any items put in paper bag 132. Upper edge 136 of paper bag 132 is held by paper bag edge holder 130 as shown in FIG. 2. Having upper edge 136 held by paper bag edge holder 130 holds paper bag 132 in place on carousel 113, and holds paper bag 132 open so that it is easy and convenient to place items in paper bag 132. Once paper bag 132 is filled, upper edge 136 can be un-coupled from paper bag edge holder 130, and paper bag 132 can be removed from bagging station 110, and an empty paper bag 132 put in its place for filling.

Paper bag edge holders, such as paper bag edge holders 130, can take many different forms for holding an upper edge 136 of paper bag 132. FIG. 4 shows two different forms of paper bag edge holders, paper bag edge holder 130 and paper bag edge holder 131. Paper bag edge holder 130 includes a spring clip 146, as shown in FIG. 4. Spring clip 146 is biased to sit against side 120, and can be pulled away from side 120 to place upper edge 136 between spring clip 146 and side 120, as shown in FIG. 2. Paper bag edge holder 131 includes a spring clip 148, as shown in FIG. 4. Spring clip 148 is biased to sit against side 120, and can be pulled away from side 120 to place upper edge 136 between spring clip 148 and side 120. FIG. 5 shows an embodiment of a paper bag edge holder 133. Paper bag edge holder 133 includes a spring clip 147 with rollers 144 as shown in FIG. 5. Spring clip 147 is biased to sit against side 120, and can be pulled away from side 120 to place upper edge 136 between spring clip 147 and side 120. Rollers 144 make it easy to slide upper edge 136 between spring clip 147 and side 120.

Paper bag edge holders 130, 131, and 133 can take any form that couples to a side 120, 122, or 124 of center piece 116 or side 135 of lid 118, and holds an upper edge 136 of paper bag 132 so that items may be placed in paper bag 132. Paper bag edge holders 130, 131, and 133 are used in some embodiments to hold an upper edge of a paper-type bag.

Bagging station 110 is used by customers and/or baggers who wish to fill one or more paper bags 132 with items. Stack of paper bags 142, or individual paper bags 132, are stored in cavity 128 of center piece 116. When it is desired to bag items, one or more paper bags 132 are removed from stack of paper bags 142. Each paper bag 132 is opened, placed on carousel 113 in an open form, and coupled to a paper bag edge holder 130 by coupling upper edge 136 of each paper bag 132 to a paper bag edge holder 130, 131, or 133, as shown in FIG. 2 with paper bag edge holder 130. In the example embodiment shown in FIG. 1, six individual paper bags 132 are opened and coupled to paper bag edge holders 130. Items are placed in each paper bag 132. Full paper bags 132 are removed by uncoupling upper edge 136 from paper bag edge holder 130 and removing full paper bag 132 from carousel 113.

FIG. 5 shows a top exploded view of lid 118 and paper bag storage basket 126. Lid 118 has opening 140. Paper bag storage basket 126 is coupled to lid 118 underneath opening 140 such that paper bags 132 are put in and taken out of paper bag storage basket 126 through opening 140. FIG. 5 shows paper bag edge holders 133 coupled to lid 118. Paper bag edge holders 130 or 131 can be coupled to lid 118 instead of or in addition to paper bag edge holders 133. In some embodiments, paper bag edge holders 130, 131, or 133 are coupled to side 120, 122, or 134 instead of to lid 118.

Figure 6:
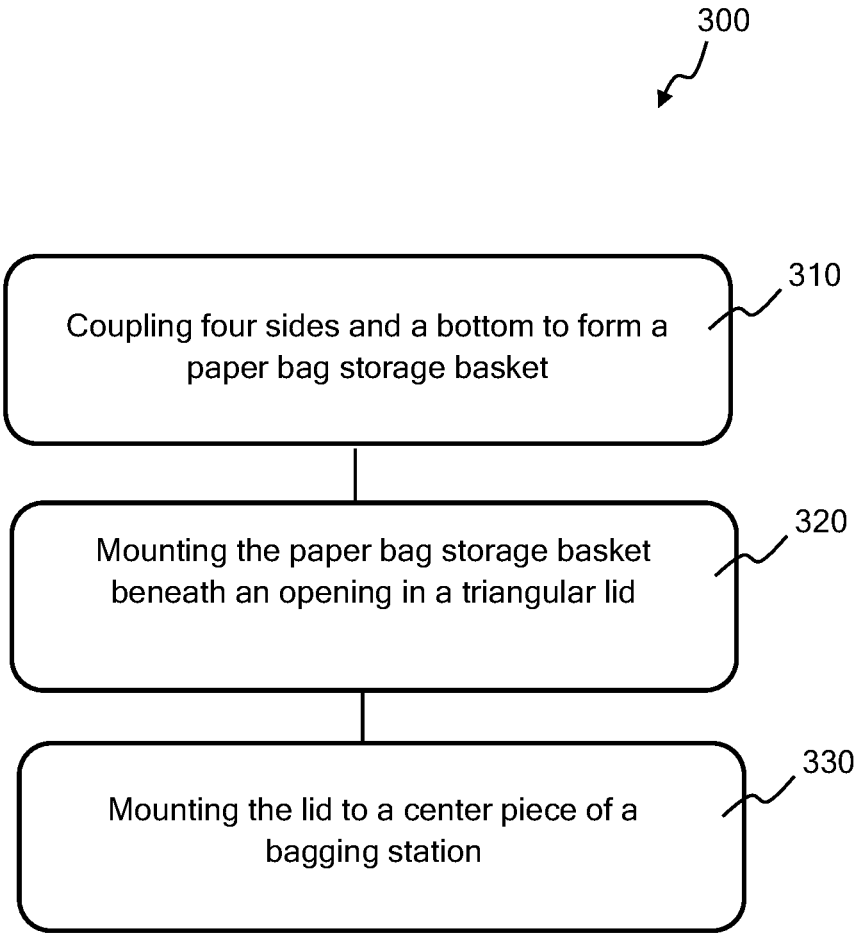
FIG. 6 illustrates a method of forming a bagging station.

FIG. 6 illustrates a method 300 of forming a paper bag bagging station. Method 300 of forming a paper bag bagging station includes an act 310 of coupling four sides and a bottom to form a paper bag storage basket. Method 300 also includes an act 320 of mounting the paper bag storage basket beneath an opening in a triangular lid. In some embodiments, the opening is rectangular in shape. In some embodiments, the paper bag storage basket is rectangular in shape.

Method 300 of forming a paper bag bagging station also includes mounting the lid to a center piece. Method 300 can include many other actions. In some embodiments, method 300 includes an act of coupling a paper bag edge holder to a side of the center piece. In some embodiments, method 300 includes an act of coupling a paper bag edge holder to the lid. In some embodiments, method 300 includes an act of storing a stack of paper bags in the paper bag storage basket. In some embodiments, method 300 includes forming an opening in a triangular lid. Forming an opening in the triangular lid can include cutting the opening in the triangular lid.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A bagging station comprising:

a base comprising a carousel;

a center piece coupled to a top surface of the carousel, wherein the center piece comprises:

three sides;

a triangular shaped lid having three lid sides; and a paper bag edge holder mounted to one of the three lid sides;

a paper bag setting on the top surface, wherein the paper bag edge holder holds an upper edge of the paper bag;

a bag storage cavity in the center piece, wherein the bag storage cavity extends into the center piece through an opening in the lid; and a paper bag storage basket mounted below the opening, wherein the paper bag storage basket comprises four sides and a bottom.

2. The bagging station of claim 1, wherein the paper bag edge holder is a clip.

3. The bagging station of claim 1, further comprising three paper bag edge holders, wherein each one of the three paper bag edge holders is mounted to one of the three lid sides.

4. The bagging station of claim 1, wherein the paper bag storage basket is sized to hold a stack of paper bags.

5. A bagging station comprising:

a center piece comprising three sides and a triangular shaped lid, wherein the center piece rests on a bagging station base;

a cavity in the center piece, wherein the cavity comprises an opening in the lid;

a paper bag storage basket mounted below the opening, wherein the paper bag storage basket comprises four sides and a bottom;

a paper bag edge holder mounted to a lid side of the lid; and a paper bag resting on the bagging station base, wherein the paper bag edge holder holds an upper edge of the paper bag for filling the paper bag.

6. The bagging station of claim 5, wherein the cavity is rectangular shaped.

7. The bagging station of claim 5, wherein the cavity is sized to hold a stack of paper bags.

8. The bagging station of claim 5, wherein the opening is rectangular shaped.

9. The bagging station of claim 5, wherein the paper bag edge holder is a clip.

10. A method of holding an open paper bag with a paper bag bagging station, the method comprising:

coupling four sides and a bottom to form a paper bag storage basket;

mounting the paper bag storage basket beneath an opening in a triangular shaped lid;

mounting the lid to a center piece of the paper bag bagging station;

coupling a paper bag edge holder to the lid; and holding an upper edge of an open paper bag with the paper bag edge holder.

11. The method of claim 10, wherein the opening is rectangular in shape.

12. The method of claim 10, wherein the paper bag storage basket is rectangular in shape.

13. The method of claim 10, further comprising forming an opening in a triangular lid.

* * * * *